US009585466B2

(12) United States Patent
Boylston

(10) Patent No.: US 9,585,466 B2
(45) Date of Patent: Mar. 7, 2017

(54) WALL MOUNTABLE TABLE AND NESTED HANGING APPARATUS

(71) Applicant: Ryan Boylston, Delray Beach, FL (US)

(72) Inventor: Ryan Boylston, Delray Beach, FL (US)

( * ) Notice: Subject to any disclaimer, the term of this patent is extended or adjusted under 35 U.S.C. 154(b) by 0 days.

(21) Appl. No.: 14/975,557

(22) Filed: Dec. 18, 2015

(65) Prior Publication Data

US 2016/0174701 A1 Jun. 23, 2016

Related U.S. Application Data

(60) Provisional application No. 62/093,868, filed on Dec. 18, 2014.

(51) Int. Cl.

| | |
|---|---|
| ***A47B 96/00*** | (2006.01) |
| ***A47B 3/08*** | (2006.01) |
| ***A47B 5/02*** | (2006.01) |
| ***A47B 96/06*** | (2006.01) |
| *A47B 95/00* | (2006.01) |

(52) U.S. Cl.

CPC ..... *A47B 3/08* (2013.01); *A47B 5/02* (2013.01); *A47B 96/067* (2013.01); *A47B 95/008* (2013.01)

(58) Field of Classification Search

CPC ..... A47C 1/1606; A47C 1/16; A47B 96/1466; A47B 95/008; A47B 97/001; A47B 97/007; A47B 85/00; A47B 7/02; A47B 31/06; A47B 2005/00

USPC ..... 40/727, 757; 312/245; 108/42, 11, 12, 108/15, 17, 18, 125, 129; 248/225.21, 248/475.1

See application file for complete search history.

(56) References Cited

U.S. PATENT DOCUMENTS

| | | | | | |
|---|---|---|---|---|---|
| 279,290 | A | * | 6/1883 | Wulbeke | A47B 5/06 108/48 |
| 2,347,176 | A | * | 4/1944 | Doner | A47G 1/215 248/469 |
| 2,549,242 | A | * | 4/1951 | Ross | A47B 85/06 108/15 |
| RE23,996 | E | * | 5/1955 | Sieminski | A47B 5/06 108/48 |

(Continued)

FOREIGN PATENT DOCUMENTS

| | | | |
|---|---|---|---|
| CA | 2539411 | * | 12/2004 |
| DE | 2128940 | * | 1/1973 |

(Continued)

*Primary Examiner* — Janet M Wilkens

(74) *Attorney, Agent, or Firm* — The Keys Law Firm PLLC

(57) ABSTRACT

A wall mountable table and nesting apparatus for providing wall art which may be additionally deployed as a freestanding table. The wall mounted table and nesting apparatus includes a wall mount defining a first French cleat style mount, a nesting member which is adapted to hang on the wall mount and provide a first display surface as well as a second French cleat style mount, and a table member which includes a plurality of selectably deployable legs and is adapted to hang on the nesting member and provide a second display surface or, in the alternative, to stand on a floor as a freestanding table. The first display surface and second display surface may include the same aesthetic design or distinct designs to provide either the same or an alternate experience depending on whether the table member is on the wall or the floor.

18 Claims, 4 Drawing Sheets

(56) References Cited

U.S. PATENT DOCUMENTS

| | | | | | |
|---|---|---|---|---|---|
| D191,272 | S | * | 9/1961 | Ungaro | D6/686 |
| 3,311,435 | A | * | 3/1967 | Heritage | A47B 95/008 108/152 |
| 4,165,852 | A | * | 8/1979 | Chervenak | A47B 95/008 108/152 |
| 6,962,016 | B1 | * | 11/2005 | Meyer | A47G 1/0605 40/700 |
| D531,488 | S | * | 11/2006 | Munson | D8/373 |
| 7,891,124 | B1 | * | 2/2011 | Willis | A47G 1/1606 248/477 |
| 9,015,977 | B2 | * | 4/2015 | Mason | A47G 1/0627 40/745 |
| 2007/0023595 | A1 | * | 2/2007 | Harmsen | A47G 1/1606 248/227.2 |
| 2008/0236053 | A1 | * | 10/2008 | Adams | A47F 7/30 52/36.1 |
| 2008/0251413 | A1 | * | 10/2008 | Blumenau-Bebry | A47G 1/0605 206/562 |
| 2013/0048812 | A1 | * | 2/2013 | Lozano | H05K 5/0204 248/220.22 |
| 2014/0203161 | A1 | * | 7/2014 | Marley, Jr. | F16M 13/02 248/475.1 |
| 2015/0351538 | A1 | * | 12/2015 | Wells | E05D 7/123 312/246 |

FOREIGN PATENT DOCUMENTS

| | | | |
|---|---|---|---|
| DE | 202012000573 | * | 12/2012 |
| FR | 3012024 | * | 4/2015 |

* cited by examiner

WALL MOUNTABLE TABLE AND NESTED HANGING APPARATUS

CROSS REFERENCE TO RELATED APPLICATIONS

This application claims the benefit of and incorporates by reference U.S. provisional patent application Ser. No. 62/093,868 filed Dec. 18, 2014.

BACKGROUND OF THE INVENTION

Field of the Invention

This invention relates generally to a combined furniture piece and aesthetic object and, more particularly, to a wall mountable apparatus configured to be deployed as both a folding table and hanging aesthetic apparatus.

Description of the Prior Art

The use and design of conventional tables, as furniture defined by a table top commonly embodied as a flat horizontal upper surface on which objects can be placed and which is integrated with table legs or another support structure, is well known. While many tables are define static structures with a table top fixedly mounted on the table legs (or to another support structure, such as a wall), folding tables that employ legs that selectively move between a deployed position and a storage position (where they would typically be folded up against the table top) are understood to be desirable when it is sought to make the table more portable or to make storage more convenient.

A problem which exists, however, is that even with the improved storage and portability capabilities of conventional folding tables, finding a place to stow such a table when it is not in use, particularly one in which it can be conveniently stowed and from which it can be conveniently deployed, is generally left to the ingenuity of the user under the constraints imposed by their living space. And notably, as in housing trends towards smaller, more efficient homes, the use of furniture pieces with space saving designs, including an ability to be conveniently stored or repurposed when not in use, has become more prevalent.

The use of functional art, commonly defined as aesthetic objects that serve utilitarian purposes, to enable the concurrent decorating and furnishing of living or work spaces is often intertwined with such housing trends, but also extends beyond. Indeed, the functional art trend spans the globe, and includes nearly all pricing tiers. In today's marketplace, functional art flourishes in the middle class market at retailers that feature democratic designs throughout their furniture and home design offerings. The combination of affordability, functionality, and beauty are strong selling points for millions who seek to find the perfect décor and furniture pieces for their homes. Functional art may include an array of home and lifestyle designs, including bedding and seating with built in elements (book shelves, expandable and retractable side tables, storage and even sectional, moveable pieces).

Modular furniture also falls into the category of functional art products. Whether by preference or necessity, modular units combine functional products with space saving design. Indeed, a new wave of micro-apartments have been outfitted with compact, yet aesthetically pleasing elements, from beds that fold into the wall or convert into dining tables to counter space that doubles as workspace. Furthermore, this wave has just begun, as micro-apartments and simplistic living methods spread from large international metropolitan centers to smaller cities and towns.

Considering such furnishing and décor trends, there remains a need for a functional art table apparatus that serves as a wall mounted piece of artwork that can be taken down and unfolded into a fully functional table. It would be helpful if such a functional art table apparatus was operative, once installed, to be moved without any tools between a storage position as artwork on the wall and a deployed position embodied as freestanding table. It would be additionally desirable for such a functional art table apparatus to be include a nesting apparatus on which the table was hung that included additional décor that remained visible when the functional art table was deployed.

The Applicant's invention described herein is essentially a custom piece of hanging art structured to be selectively convertible into a sturdy, folding table and back. The primary components of Applicant's wall mountable table and nesting apparatus are a nesting apparatus and a functional art table, enabling wall mountable table and nesting apparatus. As it can be described as functional art, combining décor with function, when in use, the wall mountable table and nesting apparatus can provide both the utility of a conventional table and the convenience of a folding table that is wall mountable through aesthetic components that contribute to the décor of the area. As a result, many of the limitations imposed by the prior art are removed.

SUMMARY OF THE INVENTION

A wall mountable table and nesting apparatus for providing a decorative and functional deployable table. Created to fit the lives and styles of urbanites, the wall mountable table and nesting apparatus transitions from custom wall art to a dining or other table in just seconds. The wall mountable table and nesting apparatus comprises two prints, one inscribed on a table member and the other inscribed on a nesting member, and a wall mount. As the table member is configured to hang on top of the nesting member when on the wall and not deployed as a table, when the table member is removed from the wall, the nesting member remains—providing an alternate, finished art experience without exposing the mounting hardware.

Both the table member and the nesting member contain sideboards for a flush fit to the wall. The table member contains four metal legs that are attached to its backside and which swing out and snap into place, converting the piece into a stable, standard height table. In one embodiment, the legs are constructed of aluminum.

The nesting member is essentially a smaller version of the table member, without the legs. It can be printed with the same custom artwork as the main piece, or with an unrelated image, providing an alternative experience when the table member is removed from the wall.

The wall mount contains countersunk, pre-drilled holes and a built in level to aid in installation to a wall. Once mounted, the wall mountable table and nesting apparatus requires no tools to utilize and reveals no mounting hardware.

Both the table member and the nesting member are configured to be liquid and stain proof and are varnished with a safe, non-slick finish.

It is an object of this invention to provide a functional art table apparatus that serves as a wall mounted piece of artwork that can be taken down and unfolded into a fully functional table.

It is another object of this invention to provide a functional art table apparatus that, once installed, was operative to be moved without any tools between a storage position as artwork on the wall and a deployed position embodied as freestanding table.

It is yet another object of this invention to provide a functional art table apparatus that includes a nesting member on which the table was hung that included additional décor that remained visible when the functional art table was deployed.

These and other objects will be apparent to one of skill in the art.

DETAILED DESCRIPTION OF THE INVENTION

Figure 1A:
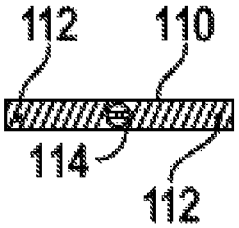
FIG. 1A is a plan view of the front side of the wall mount of a wall mountable table and nesting apparatus built in accordance with the present invention.
Figure 1B:
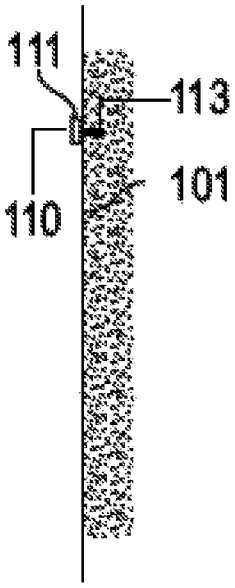
FIG. 1B is a side cross sectional view of the wall mount of a wall mountable table and nesting apparatus built in accordance with the present invention in place on a conventional wall.

Referring now to the drawings and in particular FIGS. 1A, 1B, 2A, 2B, 2C, 3A, 3B, 3C, and 4, a wall mountable table and nesting apparatus 100 is shown having a wall mount 110, a nesting member 120, and a table member 130. The wall mount 110 defines an elongated French cleat with a sloped mounting surface 111 and which includes a spirit level 114 integrated therein and a. In the preferred embodiment, the wall mount 110 includes two countersunk, pre-drilled holes 112, each of which defines a discrete aperture in the wall mount 110, to enable it to be fixedly attached to a conventional wall 101 with a screw 113 or other elongated fastening member. It is contemplated, however, that in alternated embodiments, the wall mount 110 may employ other attachment means to fixedly attach to the conventional wall 101, including an adhesive, in addition to or in the alternative to the elongated fastening member that passes through the holes 112 into the wall 101.

Figure 2A:
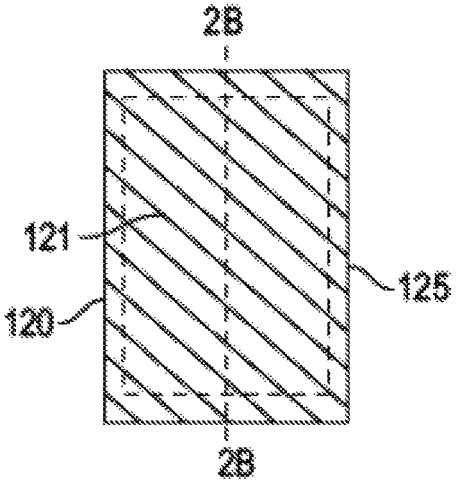
FIG. 2A is a plan view of the front side of the nested member of a wall mountable table and nesting apparatus built in accordance with the present invention.
Figure 2B:
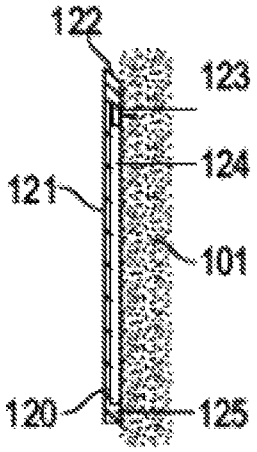
FIG. 2B is a side elevational view of a cross section of the wall mount and nested member of a wall mountable table and nesting apparatus built in accordance with the present invention in place on a conventional wall.
Figure 2C:
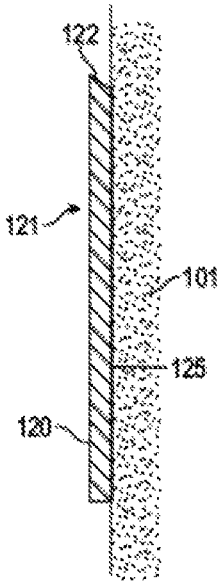
FIG. 2C is a side elevational view of the wall mount and nested member of a wall mountable table and nesting apparatus built in accordance with the present invention in place on a conventional wall.

The nesting member 120 is defined by its substantially flat nesting front surface 121, a top surface 122, and a back side having a mount edge 123 that is sized and shaped to correspond to the French cleat slope of the wall mount 110 to enable the nesting member 120 to be hung on the wall mount 110 with the mount edge 123 positioned on the wall mount 110. In the preferred embodiment, the nesting front surface 121 includes a first written indicia defining printed art or otherwise inscribed material. Accordingly, when the nesting member 120 is hung on the wall mount 110 as illustrated in FIGS. 2A, 2B, and 2C, the nesting front surface 121 displays an aesthetic design that adds to the décor of the location.

The top surface 122 is sloped, being higher at the end adjacent to the nesting front surface 121 than the end adjacent to the back side of the nesting member 120, so as to define a French cleat style surface. The top surface 122 thereby provides a surface on which the table member 130 can be hung, as discussed in greater detail below.

Beneath the mount edge 123 on the back side of the nesting member 120 is nesting recessed portion 124. The nesting recessed portion 124 defines a recess in the back side the nesting member 120 sized such that when the nesting member 120 is placed on the wall mount 110, the body of the wall mount 110 fits entirely therein. A non-recessed area of the back side of the nesting member 120 surrounds the nesting recessed portion 124, defining a nesting flush portion 125. When the nesting member 120 is hung on the wall mount 110 it is contemplated that the nesting flush portion 125 will be positioned against the wall 101, obscuring the wall mount 110.

The table member 130 is defined by its substantially flat front table surface 131 and a back side 132 having a nesting edge 133 that is sized and shaped to correspond to the sloped top surface 122 of the nesting member 120. Accordingly, when the nesting member 120 is hanging on the wall 101, the table member 130 may be hung over the nesting member 120 by resting the nesting edge 133 on the top surface 122.

Figure 3A:
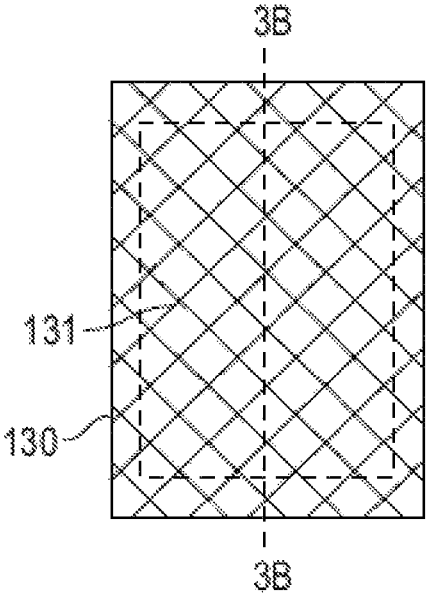
FIG. 3A is a plan view of the front side of the table member of a wall mountable table and nesting apparatus built in accordance with the present invention.
Figure 3B:
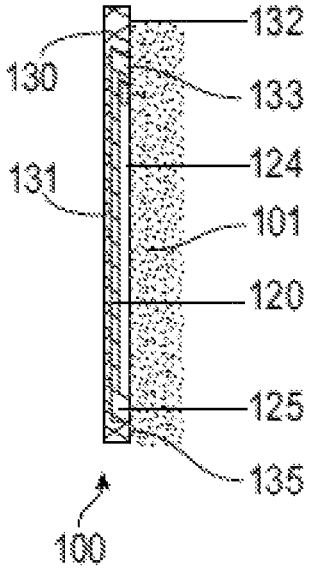
FIG. 3B is a side elevational view of a cross section of the wall mount, nested member, and table member of a wall mountable table and nesting apparatus built in accordance with the present invention in place on a conventional wall.
Figure 3C:
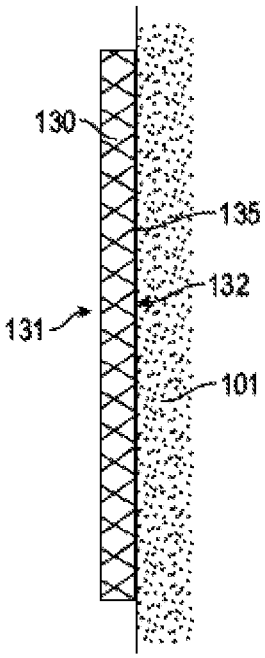
FIG. 3C is a side elevational view of the wall mount, nested member, and table member of a wall mountable table and nesting apparatus built in accordance with the present invention in place on a conventional wall.

Similar to the nesting member 120, in the preferred embodiment the front table surface 131 includes a second written indicia defining printed art or otherwise inscribed material. Thus, when the table member 130 is hung on the nesting member 120 as illustrated in FIGS. 3A, 3B, and 3C, the front table surface 131 may display an aesthetic design that adds to the décor of the location. It is contemplated that the front table surface 131 and front nesting surface 121 may include the same aesthetic design or distinct designs that is related or unrelated to provide an alternative experience depending on whether the table member 130 is hung over the nesting member 120 or deployed on a floor.

On the back side 132, beneath the nesting edge 133, is a table recessed portion 134. Similar to the nesting recessed portion 124, the table recessed portion 134 defines a recess in the back side 132 sized such that when the table member 130 is hung on the nesting member 120, the entire nesting member 120 fits entirely in the therein. A non-recessed area of the back side 132 surrounds the table recessed portion 134, defining a table flush portion 135. It is contemplated that whenever the table member 130 is hung on the wall by placing it over the nesting member 120, the table flush portion 135 is positioned against the wall 101 and obscures the nesting member 120.

Figure 4:
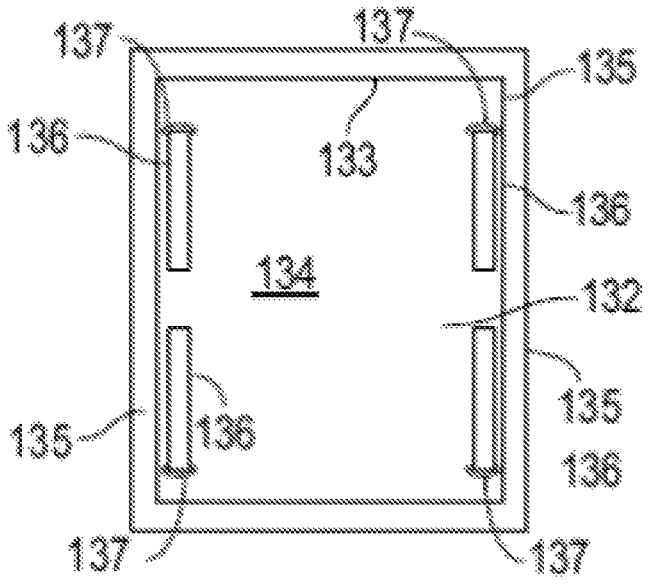
FIG. 4 is a plan view of the back side of the table member of a wall mountable table and nesting apparatus built in accordance with the present invention.
Figure 5:
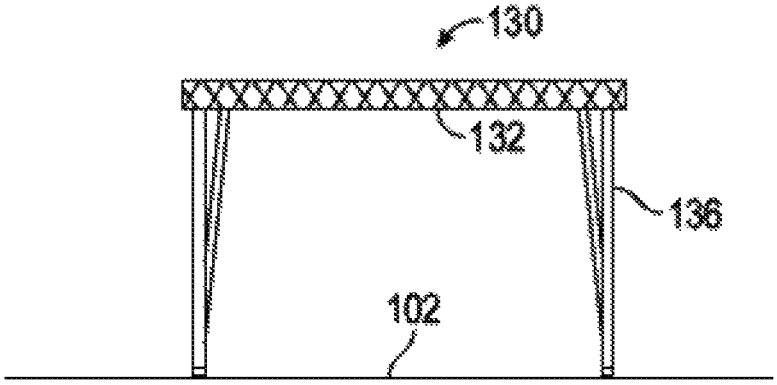
FIG. 5 is a side elevational view of the table member of a wall mountable table and nesting apparatus built in accordance with the present invention in its deployed position.

Referring now to FIGS. 3A, 3B, 3C, 4, and 5, attached at various locations on the back side 132 are table legs 136 that provide a selectively deployable support structure on which the table member 130 can stand when placed in a deployed position. The deployed position, as illustrated in FIG. 5, is defined by the legs 136 extending orthogonally from the back side 132 and standing on a floor 102. In the preferred embodiment, the legs 136 are hingedly attached to the back side 132 through a conventional hinge connector 137, such as a barrel hinge or a flush hinge.

It is contemplated that through their hinged attachment to the back side 132, the legs 136 of the table member 130 are structured to be placed into a storage position, as illustrated in FIG. 4, in which they are folded against the back side 132, as well as move from the storage position to the deployed position in which they extend outwardly from the back side 132.

It is further contemplated that in alternate embodiments, varying numbers of individual legs may be employed, including five or three, the legs may fold in varying directions, including lengthwise, crosswise, diagonally or some combination thereof, and that two or more legs may be integrated so as to hinge together.

It is additionally contemplated that in some embodiments, the table member may be completely or partially transparent so that the design on the nesting member remains visible even when the table member is hung on top of it. In such embodiments, the table member may include a transparent portion the side of the nesting member with an opaque portion, which may resemble a frame, surrounding it.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A wall mountable table and nesting apparatus, comprising:

a wall mount adapted to be attached to a wall, wherein said wall mount defines an elongated French cleat which includes a sloped mounting surface;

a nesting member having a front nesting surface, a top nesting surface, and a nesting back side that includes a mounting edge shaped to correspond to the sloped mounting surface and a nesting recessed portion defining a recess in the nesting back side sized to fit at least the wall mount when the nesting member is hung from said wall mount, wherein said nesting member is adapted to hang from said wall mount through the mounting edge;

wherein nesting back side includes a nesting flush portion defining a non-recessed area on the nesting back side adjacent to the nesting recessed portion, thereby enabling the nesting back side to be positioned against a wall to which the wall mount is attached when the nesting member is hung from the wall mount;

a table member having a front table surface and a table back side, wherein said table member is adapted to hang from said nesting member; and said table member additionally adapted for freestanding on a floor surface.

2. The wall mountable table and nesting apparatus of claim 1, wherein the nesting flush portion completely surrounds the nesting recessed portion.

3. The wall mountable table and nesting apparatus of claim 1, wherein said wall mount includes a spirit level integral therewith.

4. The wall mountable table and nesting apparatus of claim 1, wherein said table member includes a plurality of discrete table legs which are adapted to be moved between a storage position in which the table member can be hung from the nesting member and a deployed position in which the table member is adapted to be freestanding.

5. A wall mountable table and nesting apparatus, comprising:

a wall mount adapted to be attached to a wall;

a nesting member having a front nesting surface, a top nesting surface, and a nesting back side, wherein said nesting member is adapted to hang from said wall mount;

a table member having a front table surface and a table back side, wherein said table member is adapted to hang from said nesting member by engaging the top nesting surface; and said table member additionally adapted for freestanding on a floor surface.

6. The wall mountable table and nesting apparatus of claim 5, wherein said top nesting surface is sloped.

7. The wall mountable table and nesting apparatus of claim 6, wherein the table back side includes a nesting edge shaped to correspond to the top nesting surface, thereby adapting the table member to hang from said top nesting surface.

8. The wall mountable table and nesting apparatus of claim 7, wherein the table back side includes a table recessed portion defining a recess in the table back side sized to fit at least the nesting member when the table member is hung from said nesting member.

9. The wall mountable table and nesting apparatus of claim 8, wherein the table back side includes a table flush portion defining a non-recessed area on the table back side adjacent to the table recessed portion, thereby enabling the table back side to be positioned against a wall to which the wall mount is attached when the nesting member is hung from the wall mount and the table member is hung from the nesting member.

10. The wall mountable table and nesting apparatus of claim 9, wherein the table flush portion completely surrounds the table recessed portion.

11. The wall mountable table and nesting apparatus of claim 5, wherein said wall mount includes a spirit level integral therewith.

12. The wall mountable table and nesting apparatus of claim 5, wherein said table member includes a plurality of discrete table legs which are adapted to be moved between a storage position in which the table member can be hung from the nesting member and a deployed position in which the table member is adapted to be freestanding.

13. A wall mountable table and nesting apparatus, comprising:

a wall mount adapted to be attached to a wall, wherein said wall mount defines an elongated French cleat which includes a sloped mounting surface;

a nesting member having a front nesting surface, a sloped top nesting surface, and a nesting back side that includes a mounting edge, wherein said mounting edge is shaped to correspond to the sloped mounting surface, thereby adapting the nesting member to hang from said wall mount;

said nesting back side including a nesting recessed portion positioned underneath the mounting edge and defining a recess sized to fit at least the wall mount when the nesting member is hung from said wall mount;

said nesting back side additionally including a nesting flush portion defining a non-recessed area on the nesting back side adjacent to the nesting recessed portion, thereby enabling the nesting back side to be positioned against a wall to which the wall mount is attached when the nesting member is hung from the wall mount;

a table member having a front table surface and a table back side, wherein the table back side includes a nesting edge shaped to correspond to the top nesting surface, thereby adapting the table member to hang from said top nesting surface;

said table back side including a table recessed portion positioned underneath the nesting edge and defining a recess in the table back side sized to fit at least the nesting member when the table member is hung from said nesting member;

said table back side additionally including a table flush portion defining a non-recessed area on the table back side adjacent to the table recessed portion, thereby enabling the table back side to be positioned against a wall to which the wall mount is attached when the nesting member is hung from the wall mount and the table member is hung from the nesting member; and said table member additionally adapted for freestanding on a floor surface.

14. The wall mountable table and nesting apparatus of claim 13, wherein the nesting flush portion completely surrounds the nesting recessed portion.

15. The wall mountable table and nesting apparatus of claim 13, wherein the table flush portion completely surrounds the table recessed portion.

16. The wall mountable table and nesting apparatus of claim 13, wherein said wall mount includes a spirit level integral therewith.

17. The wall mountable table and nesting apparatus of claim 13, wherein said table member includes a plurality of discrete table legs which are adapted to be moved between a storage position in which the table member can be hung from the nesting member and a deployed position in which the table member is adapted to be freestanding.

18. A wall mountable table and nesting apparatus, comprising:

a wall mount adapted to be attached to a wall, wherein said wall mount defines an elongated French cleat which includes a sloped mounting surface and a spirit level integral therewith;

a nesting member having a front nesting surface, a sloped top nesting surface, and a nesting back side that includes a mounting edge, wherein said mounting edge is shaped to correspond to the sloped mounting surface, thereby adapting the nesting member to hang from said wall mount;

said nesting back side including a nesting recessed portion positioned underneath the mounting edge and defining a recess sized to fit at least the wall mount when the nesting member is hung from said wall mount;

said nesting back side additionally including a nesting flush portion defining a non-recessed area on the nesting back side which surrounds the nesting recessed portion, thereby enabling the nesting back side to be positioned against a wall to which the wall mount is attached when the nesting member is hung from the wall mount;

a table member having a front table surface and a table back side, wherein the table back side includes a nesting edge shaped to correspond to the top nesting surface, thereby adapting the table member to hang from said top nesting surface;

said table back side including a table recessed portion positioned underneath the nesting edge and defining a recess in the table back side sized to fit at least the nesting member when the table member is hung from said nesting member;

said table back side additionally including a table flush portion defining a non-recessed area on the table back side which surrounds the table recessed portion, thereby enabling the table back side to be positioned against a wall to which the wall mount is attached when the nesting member is hung from the wall mount and the table member is hung from the nesting member; and said table member additionally including a plurality of discrete table legs which are adapted to be moved between a storage position in which the table member can be hung from the nesting member and a deployed position in which the table member is adapted to be freestanding.

* * * * *